US010796672B2

(12) United States Patent
Ohba

(10) Patent No.: US 10,796,672 B2
(45) Date of Patent: Oct. 6, 2020

(54) KEYBOARD APPARATUS

(71) Applicant: YAMAHA CORPORATION, Hamamatsu-shi (JP)

(72) Inventor: Akito Ohba, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/952,674

(22) Filed: Apr. 13, 2018

(65) Prior Publication Data

US 2018/0233116 A1 Aug. 16, 2018

Related U.S. Application Data

(63) Continuation of application No. PCT/JP2016/080512, filed on Oct. 14, 2016.

(30) Foreign Application Priority Data

Oct. 15, 2015 (JP) ..... 2015-203530

(51) Int. Cl.
*G10C 3/12* (2006.01)
*G10C 3/168* (2019.01)
(Continued)

(52) U.S. Cl.
CPC ..... *G10C 3/168* (2013.01); *G10C 3/12* (2013.01); *G10C 3/18* (2013.01); *G10H 1/34* (2013.01);
(Continued)

(58) Field of Classification Search
CPC . G10C 3/168; G10C 3/12; G10C 3/18; G10B 3/12; G10H 1/34
(Continued)

(56) References Cited

U.S. PATENT DOCUMENTS

2005/0284279 A1 12/2005 Wroblewski
2009/0173206 A1* 7/2009 Inoue ..... G10C 3/22 84/243
2011/0232455 A1* 9/2011 Muramatsu ..... G10C 3/12 84/236

FOREIGN PATENT DOCUMENTS

JP H1049166 A 2/1998
JP 2005292361 A 10/2005
JP 2009163044 A 7/2009

OTHER PUBLICATIONS

International Search Report issued in Intl. Appln. No. PCT/JP2016/080512 dated Dec. 13, 2016. English translation provided.
(Continued)

*Primary Examiner* — Jianchun Qin
(74) *Attorney, Agent, or Firm* — Rossi, Kimms & McDowell LLP

(57) ABSTRACT

A keyboard apparatus includes a plurality of keys each rotatable with a predetermined stroke, a support assembly which includes a support with one side rotatably arranged with a support rail and a jack with the one side rotatably supported by the support, and rotates with depression of any of the plurality of keys, a hammer unit which is operated by receiving an action of the jack, a shank rail which rotatably supports the hammer unit, and a jack stopper which makes contact with the jack which rotates with the depression of any of the plurality of keys, the jack stopper being placed on a rotation path of the jack and provided to a fixing portion which does not rotate with the depression any of the plurality of keys.

9 Claims, 10 Drawing Sheets

(51) Int. Cl.
*G10H 1/34* (2006.01)
*G10C 3/18* (2006.01)

(52) U.S. Cl.
CPC ..... *G10H 1/346* (2013.01); *G10H 2220/305* (2013.01)

(58) Field of Classification Search
USPC ..... 84/433
See application file for complete search history.

(56) References Cited

OTHER PUBLICATIONS

Written Opinion issued in Intl. Appln. No. PCT/JP2016/080512 dated Dec. 13, 2016.
English translation of Written Opinion issued in Intl. Appln. No. PCT/JP2016/080512 dated Dec. 13, 2016, previously cited in IDS filed Apr. 13, 2018.
Office Action issued in Japanese Appln. No. 2017-545480 dated May 28, 2019. English machine translation provided.

* cited by examiner

KEYBOARD APPARATUS

CROSS-REFERENCE TO RELATED APPLICATIONS

This application is a U.S. continuation application filed under 35 U.S.C. § 111(a), of International Application No. PCT/JP2016/080512, filed on Oct. 14, 2016, which claims priority to Japanese Patent Application No. 2015-203530, filed on Oct. 15, 2015, the disclosures of which are incorporated by reference.

FIELD

An embodiment of the present invention relates to keyboard apparatuses and, for example, to the configuration of an action mechanism of a keyboard apparatus.

BACKGROUND

Acoustic pianos such as conventional grand pianos and upright pianos are configured of many components. Assembling these components is very complex, and thus assembling work takes long time. In particular, an action mechanism provided so as to correspond to each key requires many components, and thus its assembling work and adjustment is also very complex.

For example, in the action mechanism described in Japanese Patent Application Laid-Open No. 2005-292361, a plurality of components mutually acts to cause a key operation by key depression and key releasing to be transmitted to a hammer. In particular, a support assembly configuring a part of the action mechanism operates with various components combined together. The support assembly has not only a mechanism achieving string hitting by the hammer in accordance with key depression but also an escapement mechanism for releasing a force transmitted to the hammer by key operation immediately before hammer hitting. This mechanism is an important mechanism for achieving basic operation of an acoustic piano. In particular, in a grand piano, a double escapement mechanism with a repetition lever and a jack combined together is generally adopted.

The operation of the action mechanism gives a sense (hereinafter also referred to as "touch feeling") to a finger of a player through a key. In particular, the configuration of the support assembly has an important influence on the touch feeling. For example, the touch feeling by operation of the escapement mechanism is called let-off.

SUMMARY

According to one embodiment of the present invention, a keyboard apparatus includes a plurality of keys each rotatable with a predetermined stroke, a support assembly which includes a support with one side rotatably arranged with respect to a support rail and a jack with the one side rotatably supported by the support, and rotates with depression of any of the plurality of keys, a hammer unit which is operated by receiving an action of the jack, a shank rail which rotatably supports the hammer unit, and a jack stopper which makes contact with the jack which rotates with the depression of any of the plurality of keys, the jack stopper being placed on a rotation path of the jack and provided to a fixing portion which does not rotate with the depression any of the plurality of keys.

DESCRIPTION OF EMBODIMENTS

Figure 1:
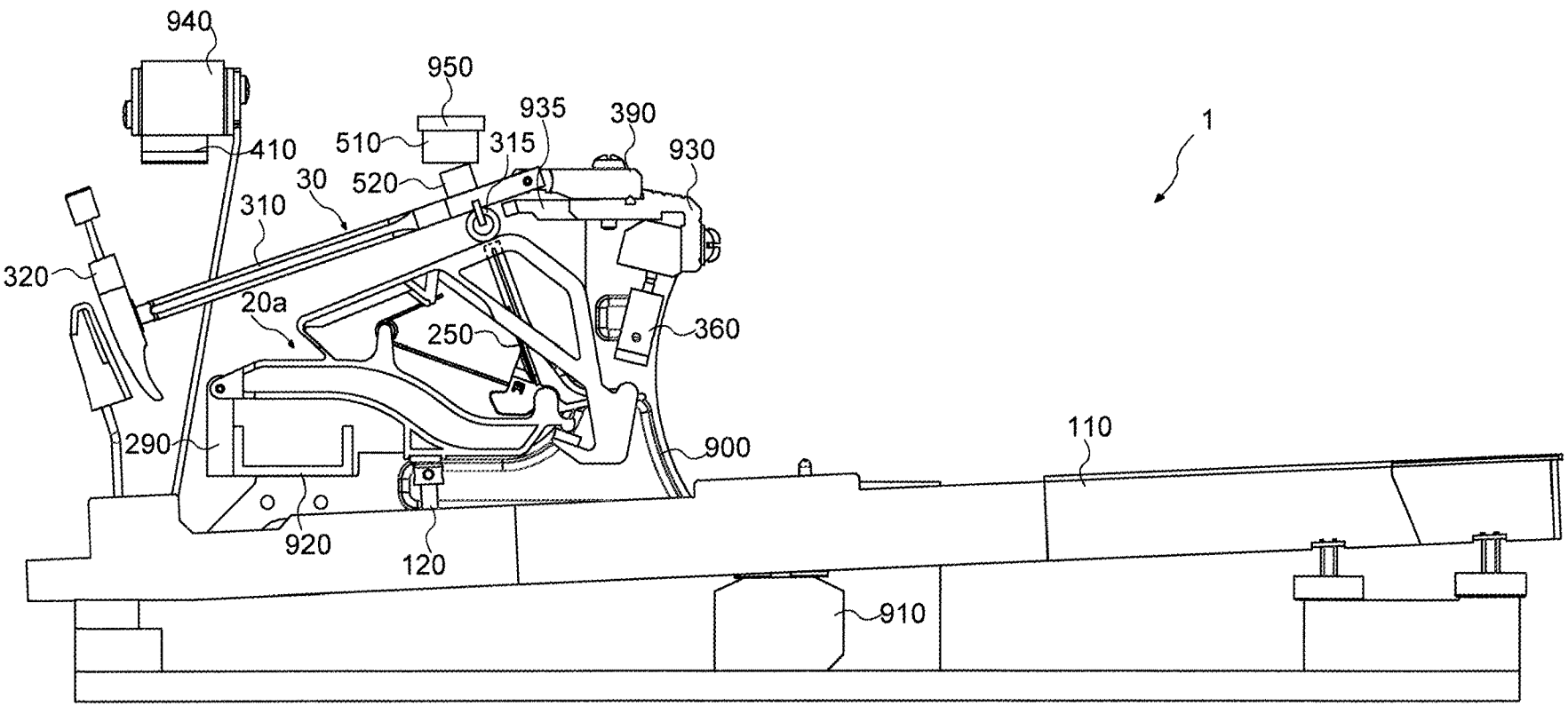
FIG. 1 is a side view showing the configuration of a keyboard apparatus according to one embodiment of the present invention.

In the following, a keyboard apparatus including a support assembly in one embodiment of the present invention is described in detail with reference to the drawings. Each embodiment described below represents one example of embodiments of the present invention, and the present invention should not be construed as being limited to these embodiments. Note that in the drawings referred to in the embodiments, same portions or portions having a similar function are provided with a same reference character or similar reference character (a reference character merely with A, B, or the like subsequent to a numeral) and repetitive description of these portions may be omitted. Also, for convenience of description, a dimensional ratio of each drawing (such as a ratio among configurations or a ratio among a vertical, lateral, and height directions) may differ from an actual ratio, and a configuration may be partially omitted from the drawing.

The action mechanism is configured of many components, and therefore its manufacturing period is long and manufacturing cost is high. For reduction of the manufacturing cost, it is desired to simply decrease the number of components to simplify the configuration. However, even if the number of components of the action mechanism is reduced, the touch feeling at the tie of key operation is desired not to be changed much. Also, even if the number of components of the action mechanism is reduced to simplify the configuration, the support assembly is desired to stably operate as following key depression.

One embodiment of the present invention discloses a keyboard apparatus capable of reducing a change of touch feeling at the time of key operation even with a simplified configuration, compared with keyboard apparatuses of an acoustic-piano type.

First Embodiment

1. Configuration of Keyboard Apparatus

A general outline of a keyboard apparatus according to one embodiment of the present invention is described with reference to FIG. 1. A keyboard apparatus 1 showing in FIG. 1 can be applied as, for example, an action mechanism of an electronic piano. To obtain the touch feeling similar to that of a grand piano at the time of key operation, this electronic piano has a configuration similar to a support assembly included in the grand piano. By using FIG. 1, the general outline of the keyboard apparatus 1 according to one embodiment of the present invention is described.

FIG. 1 is a side view showing a mechanical configuration of the keyboard apparatus 1 according to one embodiment of the present invention. As shown in FIG. 1, the keyboard apparatus 1 according to one embodiment of the present invention includes a plurality of keys 110 (eighty-eight keys in this example) and action mechanisms corresponding to the respective keys 110. The action mechanisms each include a support assembly 20*a* and a hammer assembly 30. Note that while FIG. 1 shows a case in which the key 110 is a white key, the same applies if the key is a black key. Also, in the following description, terms representing orientations such as a side toward the front of a player, a side at the back with respect to the player, upward/above, downward/below, and sideward, are defined as orientations when the keyboard apparatus is viewed from a player's side. In the example shown in FIG. 1, the support assembly 20*a* is placed upward on the side toward at the back with respect to the player when viewed from the key 110. A sideward direction corresponds to a direction in which the keys 110 are arranged.

The key 110 is rotatably supported by a balance rail 910. The key 110 rotates in a range from a rest position shown in FIG. 1 to an end position with a predetermined stroke. Here, the "rest position" is a key position where the key is not pressed down, and the "end position" is a key position where the key is completely pressed down. The key 110 includes a capstan screw 120. The support assembly 20*a* is rotatably connected to a support flange 290, and is mounted on the capstan screw 120. The support flange 290 is fixed to a support rail 920. A jack 250 is rotatably provided to the support assembly 20*a*. The detailed configuration of the support assembly 20*a* will be described further below. Note that the support flange 290 and the support rail 920 are each an example of a frame serving as a reference of rotation of the support assembly 20*a* and the frame is only required to be capable of rotatably supporting a support and is not limited to be configured as described in the present embodiment. For example, the frame may be formed of a plurality of members such as the support flange 290 and the support rail 920 or may be formed of one member. The frame may be a rail-shaped member such as the support rail 920 with its direction of the length being an arrangement direction of the keys 110, or may be an independent member for each key 110, such as the support flange 290.

The hammer assembly 30 includes a shank rail 930 and a shank flange 390, which form a fixing portion, and a hammer 320, a hammer shank 310, and a hammer roller 315 rotatably provided to these shank rail 930 and shank flange 390. Specifically, the hammer shank 310 is rotatably connected to the shank flange 390. The hammer shank 310 includes the hammer roller 315. The hammer shank 310 is mounted on the support assembly 20*a* via the hammer roller 315. The shank flange 390 is fixed to the shank rail 930. The hammer 320 is fixed to an end of the hammer shank 310. A hammer stopper 410 is fixed to a hammer stopper rail 940 and is placed at a position of regulating the rotation of the hammer shank 310.

While FIG. 1 shows an example including the hammer 320, the hammer shank 310, and the hammer roller 315 as components of the hammer assembly 30, the hammer assembly 30 is only required to be a hammer unit rotatable with respect to a member equivalent to a shank rail, and is not limited to the present embodiment. For example, the hammer shank 310 and the hammer roller 315 may be integrally formed as members of a hammer unit. That is, a member corresponding to the hammer roller 315 may be included in the configuration of the hammer shank 310. Alternatively, a member corresponding to the hammer roller 315 is provided on a jack 250 side. Also, the shank rail 930 is not limited to the present embodiment, and is only required to rotatably support the hammer assembly 30. For example, the shank rail 930 may not be in a form of a rail. In any case, the hammer assembly 30 is configured to include a fixing portion and a rotating portion which rotates by the action of the jack 250 as will be described further below.

A regulating portion 360 which regulates the rotation of the support assembly 20*a* and a jack stopper 935 which regulates the rotation of the jack 250 are provided to the fixing portion. For example, the jack stopper 935 is provided to the shank rail 930. Also, the jack stopper 935 may be provided to the shank flange 390. In this manner, with the jack stopper 935 provided to the existing fixing portion, a new member is not required to be added, thereby allowing reduction of the number of components. Also, with the jack stopper 935 provided to the fixing portion, the position of a contact surface with which the jack 250 is in contact can be easily adjusted at the time of manufacture and maintenance.

A sensor 510 detects the operation of the hammer assembly 30. The sensor 510 exemplarily shown in FIG. 1 is a sensor for measuring a position and a moving speed (in particular, a speed immediately before the hammer shank 310 collides with the hammer stopper 410) of the hammer shank 310. The sensor 510 is fixed to a sensor rail 950. In this example, the sensor 510 is a photointerruptor. An output value from the sensor 510 changes in accordance with an amount of shielding the optical axis of the photointerruptor by a shielding plate 520 fixed to the hammer shank 310. Based on this output value, the position and the moving speed of the hammer shank 310 can be measured. Note that, in place of or together with the sensor 510, a sensor for measuring an operation state of the key 110 may be provided.

The above-described support rail 920, shank rail 930, hammer stopper rail 940, and sensor rail 950 are supported by a bracket 900. That is, in the keyboard apparatus 1 shown in FIG. 1, the shank flange 390 and the shank rail 930 supporting this shank flange 390 and the support flange 290 and the support rail 920 supporting this support flange 290 are fixed by the bracket 900, and these members serve as a fixing portion. By contrast, the hammer shank 310 and its accompanying hammer 320, the hammer roller 315, and the support assembly 20*a* serve as a movable portion which rotates with depression of the key 110. This configuration is merely an embodiment to implement the present invention and does not limit the present invention.

2. Configuration of Support Assembly

Figure 2:
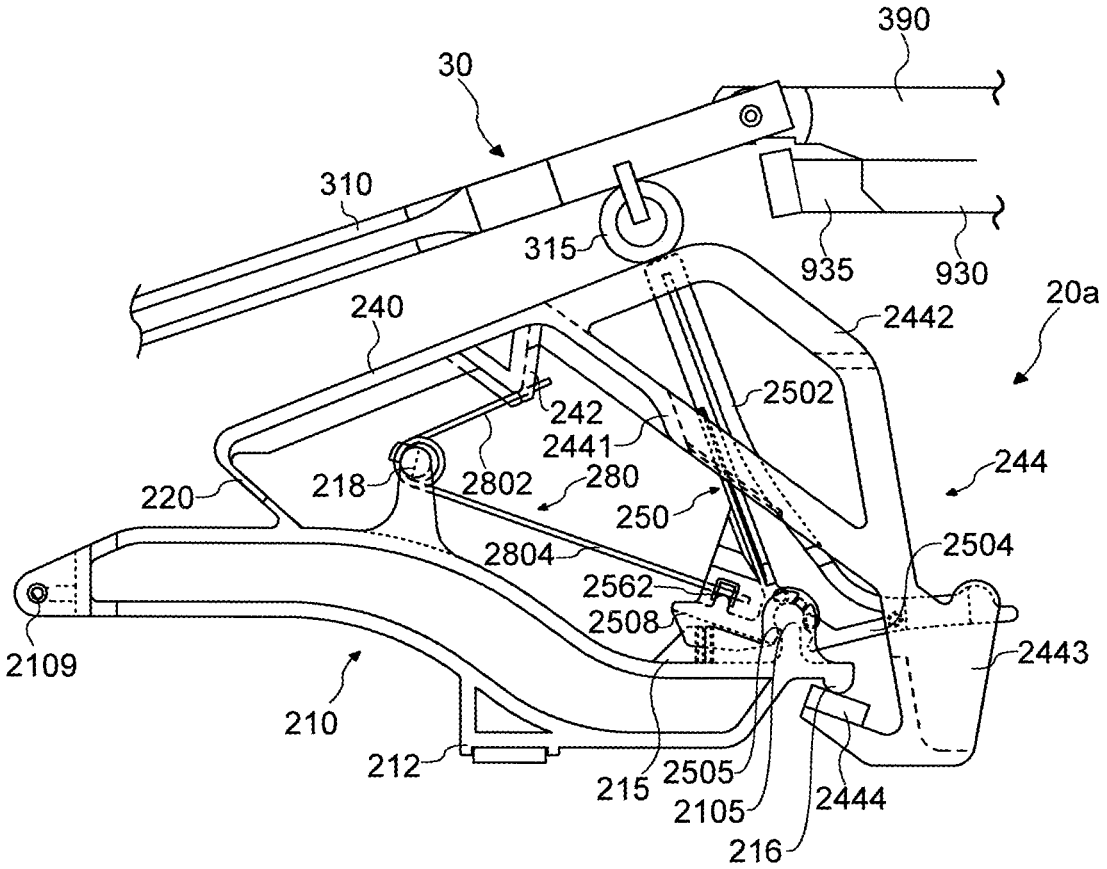
FIG. 2 is a side view showing the configuration of a support assembly and a jack stopper in the keyboard apparatus according to one embodiment of the present invention.

FIG. 2 is a side view showing the configuration of the support assembly according to one embodiment of the present invention. The support assembly 20*a* shown in FIG. 2 includes a support 210, a repetition lever 240, the jack 250, and a torsion coil spring 280. The support 210 and the repetition lever 240 are coupled via a flexible portion 220. By the flexible portion 220, the repetition lever 240 is rotatably supported with respect to the support 210. The support assembly 20*a* is a resin-made structure manufactured by injection molding or the like, except for the torsion coil spring 280, a shock-absorbing material (such as unwoven fabric or an elastic body) provided to a portion which collides with another member, and so forth. In this example, the support 210 and the repetition lever 240 are integrally formed. The support 210 and the repetition lever 240 may be formed as individual components bonded or joined together.

The support 210 has one end side formed with a through hole 2109 and the other end side formed with a jack support portion 2105. Between the through hole 2109 and the jack support portion 2105, the support 210 includes a support heel 212 projecting downward and a spring support portion 218 projecting upward. Through the through hole 2109, a shaft supported by the support flange 290 fixed to the support rail 920 penetrates. This causes the support 210 to be rotatably arranged with respect to the support flange 290 and the support rail 920. Thus, the through hole 2109 serves as a rotation center of the support 210.

The lower surface of the support heel 212 makes contact with the above-described capstan screw 120. The spring support portion 218 supports the torsion coil spring 280. The jack support portion 2105 rotatably supports the jack 250. Thus, the jack support portion 2105 serves as a rotation center of the jack 250.

Between the through hole 2109 (the rotation center of the support 210) and the jack support portion 2105 (the rotation center of the jack 250), a space is present on a jack support portion 2105 side with respect to the support heel 212. The jack support portion 2105 projects upward from the support 210. Also, coupled to an end of the support 210 is a stopper 216. The support heel 212 is placed below the support 210.

A spring contact portion 242 and an extension portion 244 are coupled to the repetition lever 240. The spring contact portion 242 and the extension portion 244 extend from the repetition lever 240 to a support 210 side. The spring contact portion 242 makes contact with a first arm 2802 of the torsion coil spring 280. The repetition lever 240 and the extension portion 244 include two plate-shaped members interposing from sides of both side surfaces of the jack 250. In this example, the extension portion 244 and the jack 250 slidably make contact with each other in at least a part of a space interposed by these two plate-shaped members.

The extension portion 244 includes an inner portion 2441, an outer portion 2442, a coupling portion 2443, and a stopper contact portion 2444. In the repetition lever 240, the inner portion 2441 is coupled to the side at the back with respect to the player (flexible portion 220 side) with respect to a large jack (first jack) 2502. The inner portion 2441 crosses as interposing the large jack (first jack) 2502 and extends to the side toward the front of the player (the side opposite to the flexible portion 220) with respect to the large jack (first jack) 2502. That is, it can also be said that the extension portion 244 crosses the jack 250. The inner portion 2441 includes, in a portion interposing the large jack (first jack) 2502, a linearly-shaped protruding portion projecting to a large jack (first jack) 2502 side.

The outer portion 2442 of the repetition lever 240 is coupled to the side toward the front of the player (the side opposite to the flexible portion 220) with respect to the jack 250 (large jack (first jack) 2502). The inner portion 2441 and the outer portion 2442 are coupled together at the coupling portion 2443. The coupling portion 2443 interposes a small jack (second jack) 2504. The stopper contact portion 2444 is coupled to the coupling portion 2443, and makes contact with the stopper 216 from below the stopper 216. The stopper 216 regulates a rotation range of the repetition lever 240 to a direction in which the repetition lever 240 and the support 210 spread (upward). A guide portion 215 includes paired members projecting upward so as to interpose a part of the jack 250 from the support 210.

The jack 250 includes the large jack (first jack) 2502, the small jack (second jack) 2504, and a projecting portion 2508. The jack 250 is rotatably arranged with respect to the support 210. Between the large jack (first jack) 2502 and the small jack (second jack) 2504, a support connecting portion 2505 for being rotatably supported by the jack support portion 2105 is formed. The support connecting portion 2505 has a shape surrounding a part of the jack support portion 2105, and regulates a rotation range of the jack 250. The jack 250 can fit from above the jack support portion 2105 due to the shape of the support connecting portion 2505 and elastic deformation of its material thereof. The projecting portion 2508 projects from the large jack (first jack) 2502 to a side opposite to the small jack (second jack) 2504, and rotates with the jack 250. The projecting portion 2508 includes, on its side surface, a spring contact portion 2562. The spring contact portion 2562 makes contact with a second arm 2804 of the torsion coil spring 280.

FIG. 2 also shows one embodiment of the jack stopper 935 which makes contact with a part of the large jack (first jack) 2502. The jack stopper 935 is a fixing portion of the action mechanism, and is fixed to, for example, the shank rail 930. With the jack stopper 935 provided not to the support assembly 20*a* but to the fixing portion of the action mechanism, the configuration of the support assembly 20*a* can be simplified, and the weight thereof can also be decreased.

The jack stopper 935 regulates the rotation of the jack 250, and thus is preferably formed of a soft material. At least a contact surface of the jack stopper 935 which makes contact with the large jack (first jack) 2502 is preferably formed of a soft material. A preferable example of the soft material is felt. With the soft material used for the jack stopper 935, a contact sound at the time of operation of the action mechanism can be reduced.

In FIG. 2, with the torsion coil spring 280 taking the spring support portion 218 as a supporting point, the first arm 2802 makes contact with the spring contact portion 242, and the second arm 2804 makes contact with the spring contact portion 2562. The first arm 2802 functions as an elastic body which provides a rotating force to the repetition lever 240 via the spring contact portion 242 so as to move the player's side of the repetition lever 240 upward (a direction away from the support 210). The second arm 2804 functions as an elastic body which provides a rotating force to the jack 250 via the spring contact portion 2562 so as to move the projecting portion 2508 downward (to a support 210 side).

In the present embodiment, the configuration of the support assembly is not limited to that shown in FIG. 2. For example, as in a support assembly 20*a*_2 shown in FIG. 3, the outer portion 2442 may be omitted in the extension portion 244 of the repetition lever 240. As the extension portion 244, it is only required that the coupling portion 2443 is coupled to an end of the inner portion 2441 and a first contact portion 2445 is included in that coupling portion. With the jack stopper 935 provided to the fixing portion such as the shank rail 930, the support assembly 20*a*_2 can achieve operations and effects similar to those of the support assembly 20*a* shown in FIG. 2, regulating the rotation of the jack 250 and stabilizing the operation.

While FIG. 1 and FIG. 2 shows the configuration in one key as an action mechanism, a similar configuration can be applied to all keys in the keyboard apparatus. In this case, the jack stopper 935 may be commonly provided to a plurality of keys, and the jack stopper 935 may be shared by to the plurality of keys. For example, the jack stopper 935 contiguously connected to a plurality of keys for each octave may be provided. In the other word, the jack stopper 935 has a width in contact with the jack 250 respectively arranged to the plurality of keys for each octave units. That is, according to the present embodiment, with the jack stopper 935 provided to the fixing portion of the action mechanism, the jack stopper 935 can be shared by a plurality of keys, thereby allowing reduction of the number of components.

3. Operation of Support Assembly

The operation of the support assembly 20*a* and the hammer assembly 30 when the key 110 at the rest position (FIG. 1) is pressed down to the end position is described.

Figure 4:
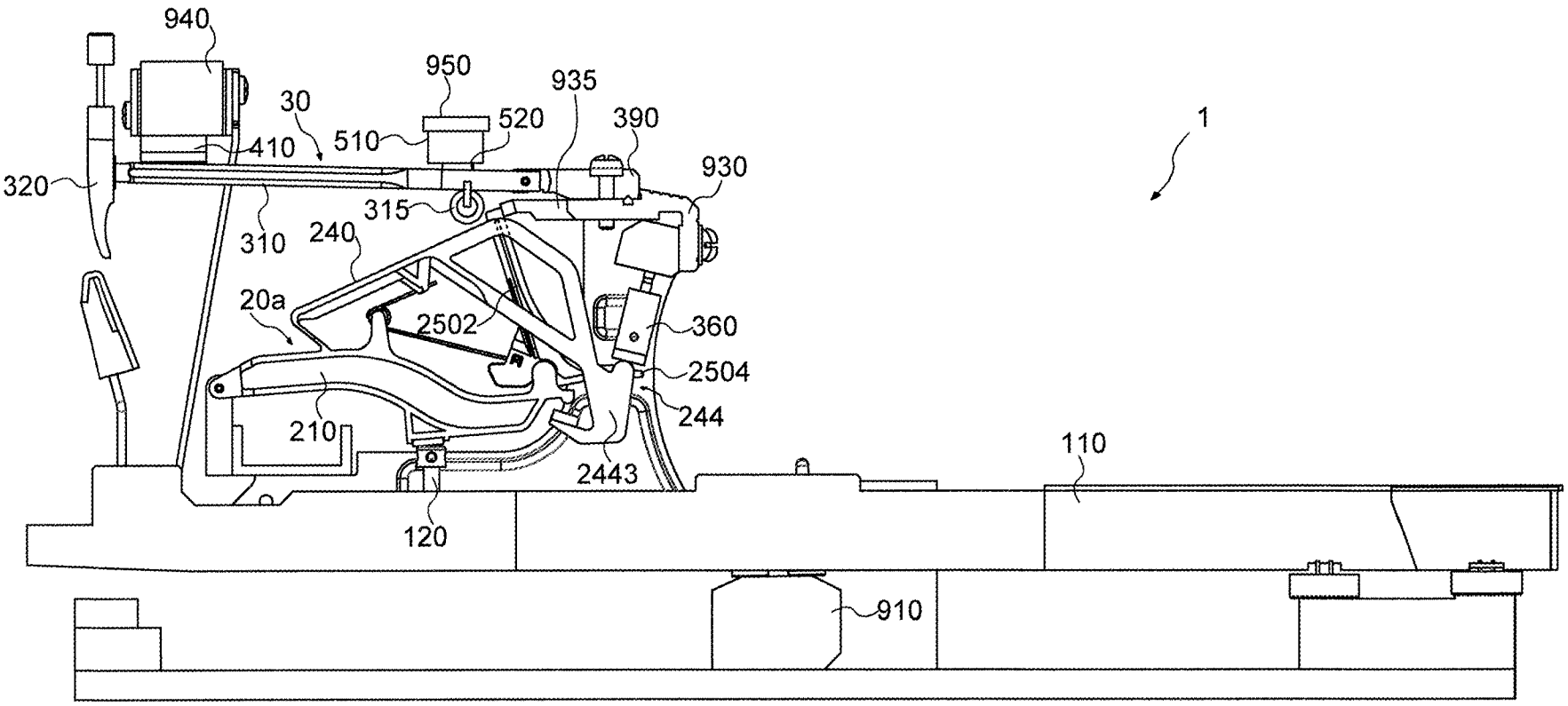
FIG. 4 is a side view for describing a motion of the support assembly according to one embodiment of the present invention.

FIG. 4 is a side view for describing a motion of the support assembly 20*a* according to one embodiment of the present invention. When the key 110 is pressed down to the end position, the capstan screw 120 presses up the support heel 212 to rotate the support 210 with the axis of the through hole 2109 taken as a rotation center. When the support 210 rotates to move upward, the jack 250 acts on the hammer assembly 30 to operate the hammer assembly 30. That is, the hammer assembly 30 operates upon receiving the action from the jack 250 by key depression directly or via another member. Specifically, the large jack (first jack) 2502 presses up the hammer roller 315 to cause the hammer shank 310 to collide with the hammer stopper 410. Note that in the case of a general grand piano, this collision corresponds to string hitting by the hammer.

Figure 5A:
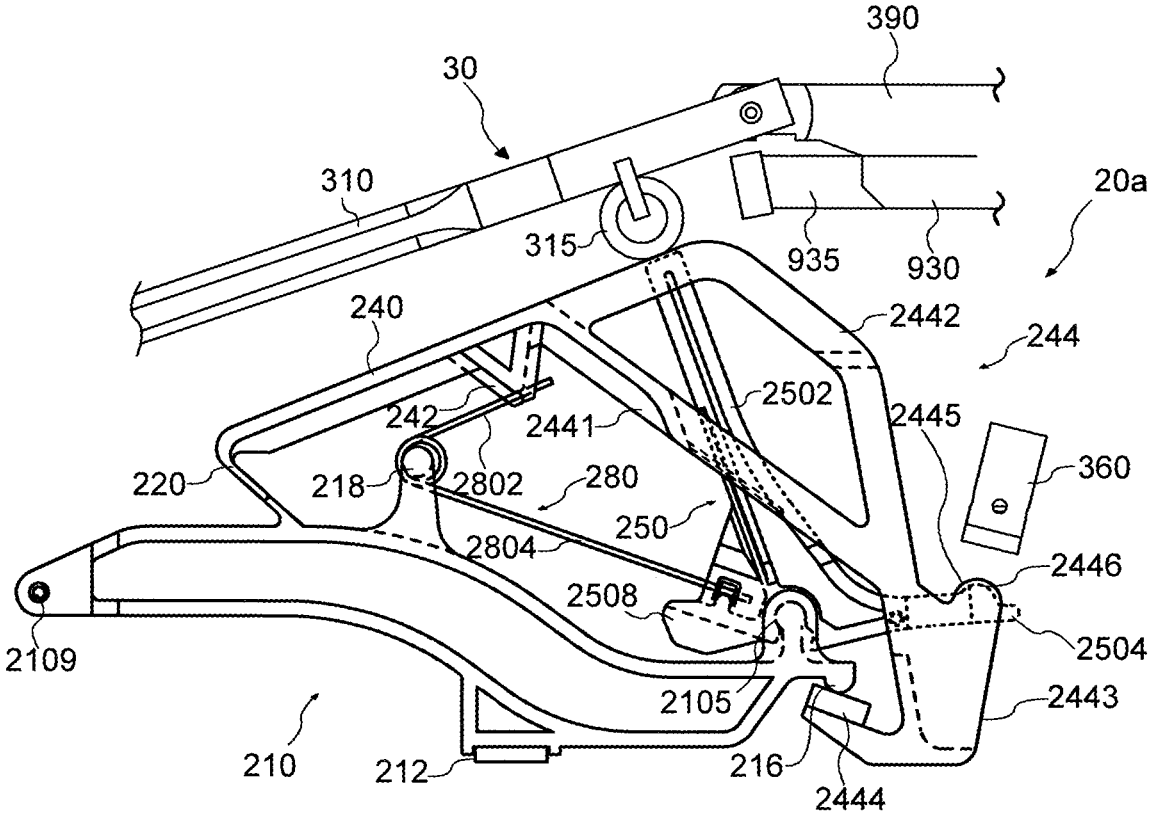
FIG. 5A is a side view for describing a motion of the support assembly according to one embodiment of the present invention.
Figure 5B:
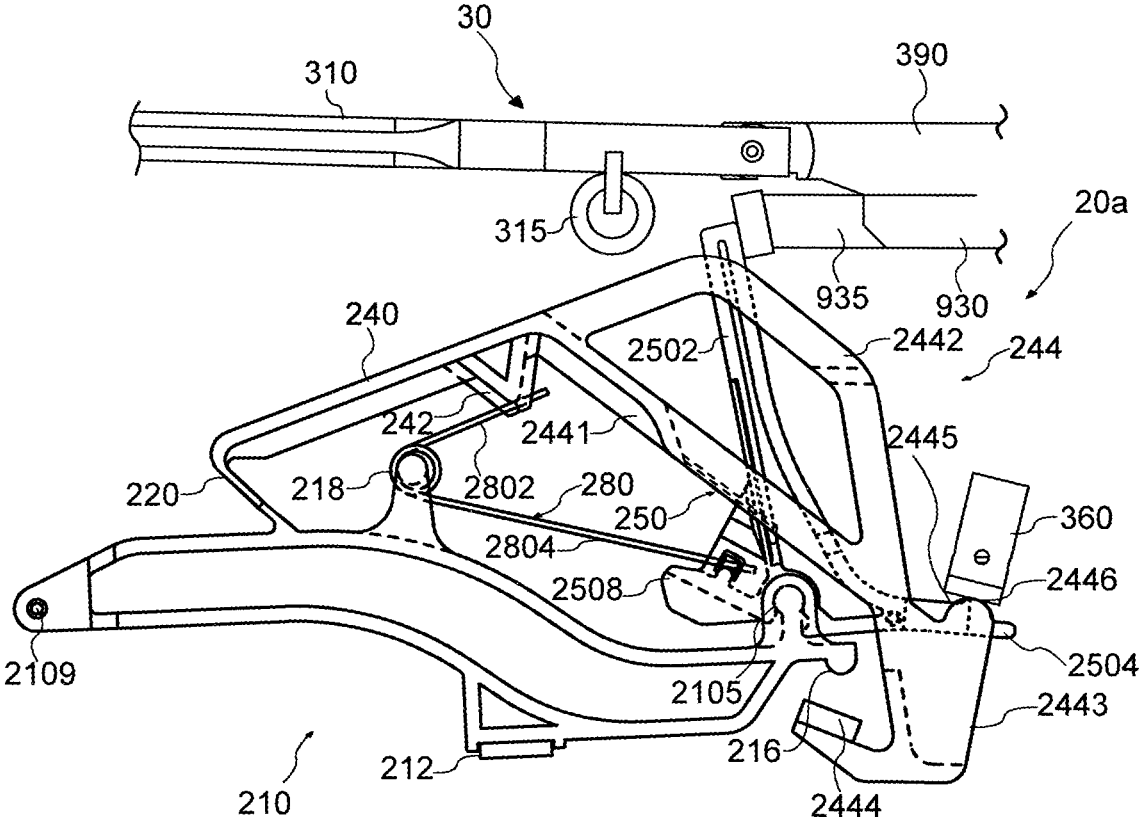
FIG. 5B is a side view for describing a motion of the support assembly according to one embodiment of the present invention.

Motions of the support assembly 20*a* and the hammer assembly 30 at this time are shown in FIG. 5A and FIG. 5B. FIG. 5A shows the state of the support 210, the repetition lever 240, and the jack 250 before the key is pressed down. In this state, the hammer roller 315 is supported by the repetition lever 240. A tip of the large jack (first jack) 2502 on the other side overlaps the outer portion 2442 of the extension portion 244. The projecting portion 2508 provided to the jack 250 is retained as being away from the support 210. In this state, the stopper contact portion 2444 in the extension portion 244 of the repetition lever 240 is retained as being in contact with the stopper 216 of the support 210. Here, the first contact portion 2445 of the coupling portion 2443 and a second contact portion 2446 of the small jack (second jack) 2504 are away from the regulating portion 360.

FIG. 5B shows a state (operation state) when the key is pressed down. The support 210 rotates, and a side toward the front of the player rotates upward. Immediately before the hammer shank 310 collides with the hammer stopper 410, the second contact portion 2446 of the small jack (second jack) 2504 makes contact with the regulating portion 360 to regulate upward rotation and further cause the support 210 (jack support portion 2105) to ascend. With the upward rotation regulated and the jack support portion 2105 ascending, the large jack (first jack) 2502 rotates so as to be detached from the hammer roller 315. Here, the jack stopper 935 is provided on a rotation path of the large jack (first jack) 2502. The operation of being detached from the hammer roller 315 may cause the large jack (first jack) 2502 to rotate to a position of making contact with the jack stopper 935. The repetition lever 240 rotates together with the support 210, and the first contact portion 2445 in the coupling portion 2443 makes contact with the regulating portion 360 at the same timing as the second contact portion 2446. This regulates upward rotation of the repetition lever 240, which is displaced so as to approach the support 210. Then, when the key 110 is returned to a rest position, the hammer roller 315 is supported by the repetition lever 240, and the large jack (first jack) 2502 is returned below the hammer roller 315. These operations achieve a double escapement mechanism. In this case, the jack stopper 935 is provided on the rotation path of the large jack (first jack) 2502 in association with key depression. This configuration can prevent the jack 250 from being away from the hammer roller 315 and having difficulty in returning, and can stabilize the operation of the jack 250. This can reduce a change of the touch feeling at the time of key operation.

4. Sound Generating Mechanism of Keyboard Apparatus

The keyboard apparatus 1 is an example of application to an electronic piano as described above, and has the operation of the key 110 measured by the sensor 510 to output a sound corresponding to the measurement result.

Figure 6:
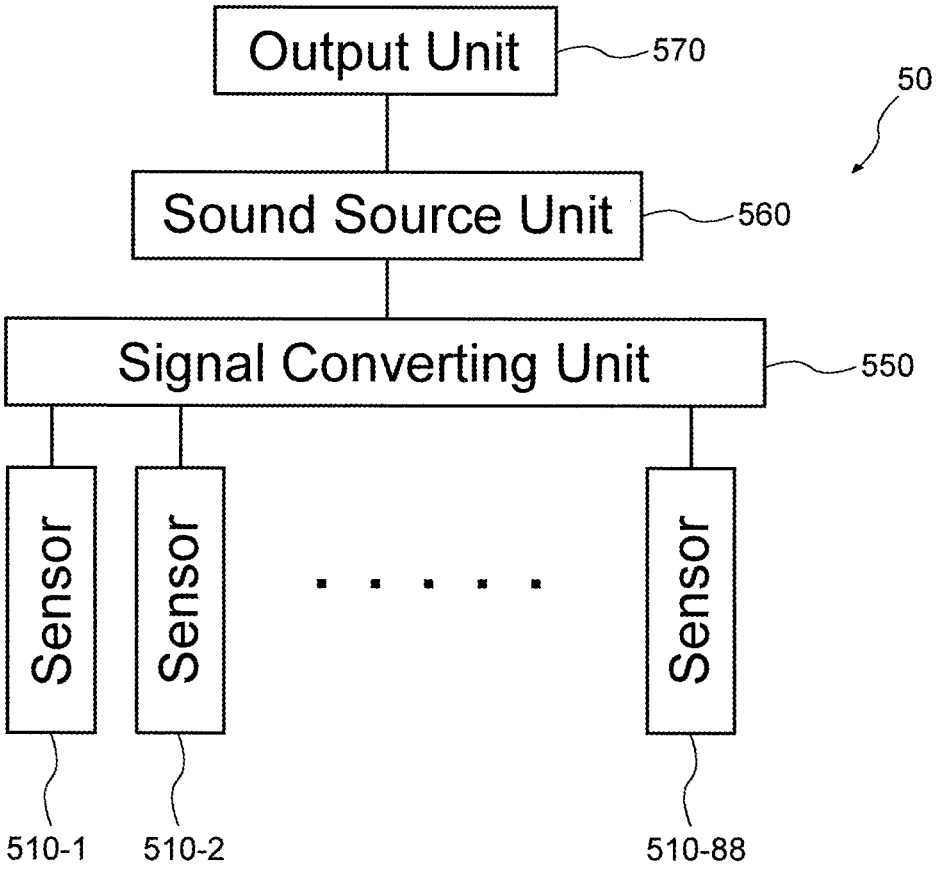
FIG. 6 is a block diagram showing the configuration of a sound emission mechanism of a keyboard apparatus in a first embodiment of the present invention.

FIG. 6 is a block diagram showing the configuration of a sound generating mechanism of the keyboard apparatus in one embodiment of the present invention. A sound generating mechanism 50 of the keyboard apparatus 1 includes the sensor 510 (sensors 510-1, 510-2, . . . 510-88 corresponding to the 88 keys 110), a signal converting unit 550, a sound source unit 560, and an output unit 570. The signal converting unit 550 obtains an electrical signal outputted from the sensor 510, and generates and outputs an operation signal in accordance with the operation state in each key 110. In this example, the operation signal is a signal in MIDI format. Thus, in accordance with the timing when the hammer shank 310 collides with the hammer stopper 410 by a key-depressing operation, the signal converting unit 550 outputs note-ON. Here, a key number indicating which of the eighty-eight keys 110 has been operated and a velocity corresponding to the speed immediately before collision are also outputted in association with the note-ON. On the other hand, when a key-releasing operation is performed, in accordance with the timing when string vibrations are stopped by a damper in the case of a ground piano, the signal converting unit 550 outputs the key number and note-OFF in association with each other. To the signal converting unit 550, a signal in accordance with another operation such as that of a pedal may be inputted and reflected onto the operation signal. The sound source unit 560 generates a sound signal based on the operation signal outputted from the signal converting unit 550. The output unit 570 is a loudspeaker or terminal which outputs the sound signal generated by the sound source unit 560.

Second Embodiment

1. Configuration of Support Assembly

Figure 3:
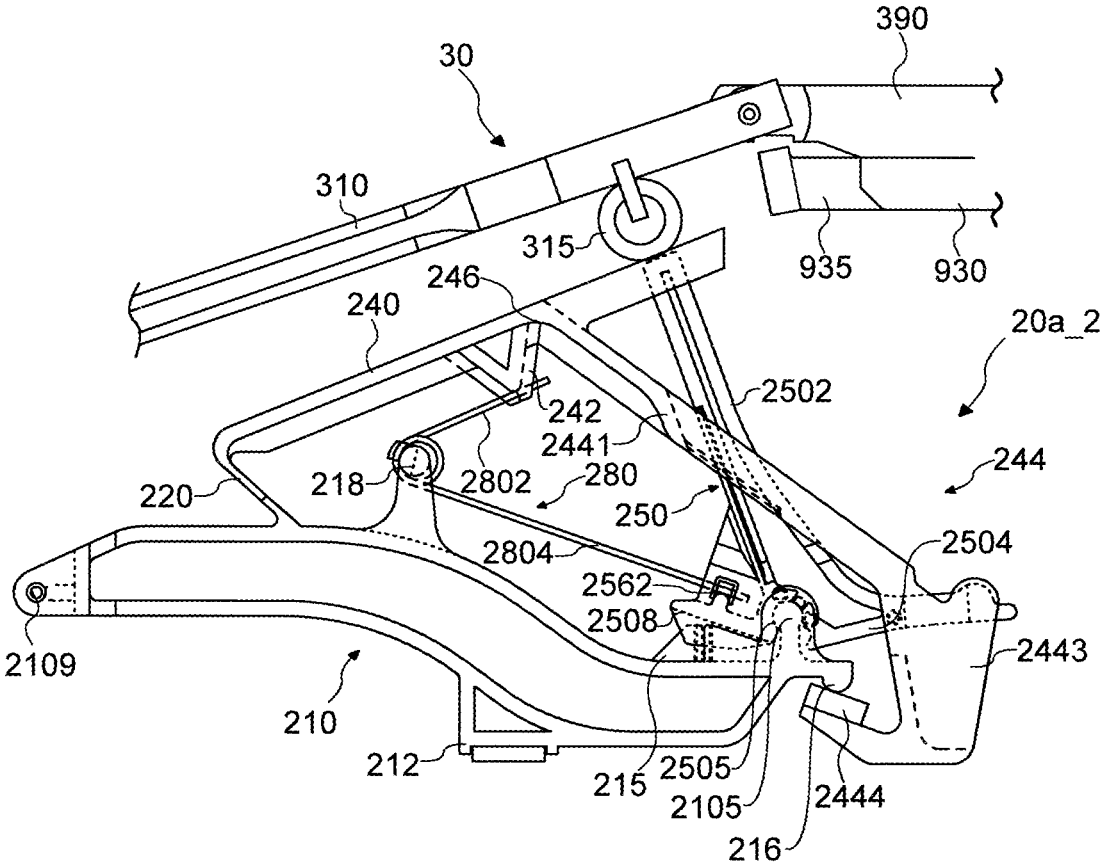
FIG. 3 is a side view showing the configuration of the support assembly and the jack stopper in the keyboard apparatus according to one embodiment of the present invention.
Figure 7:
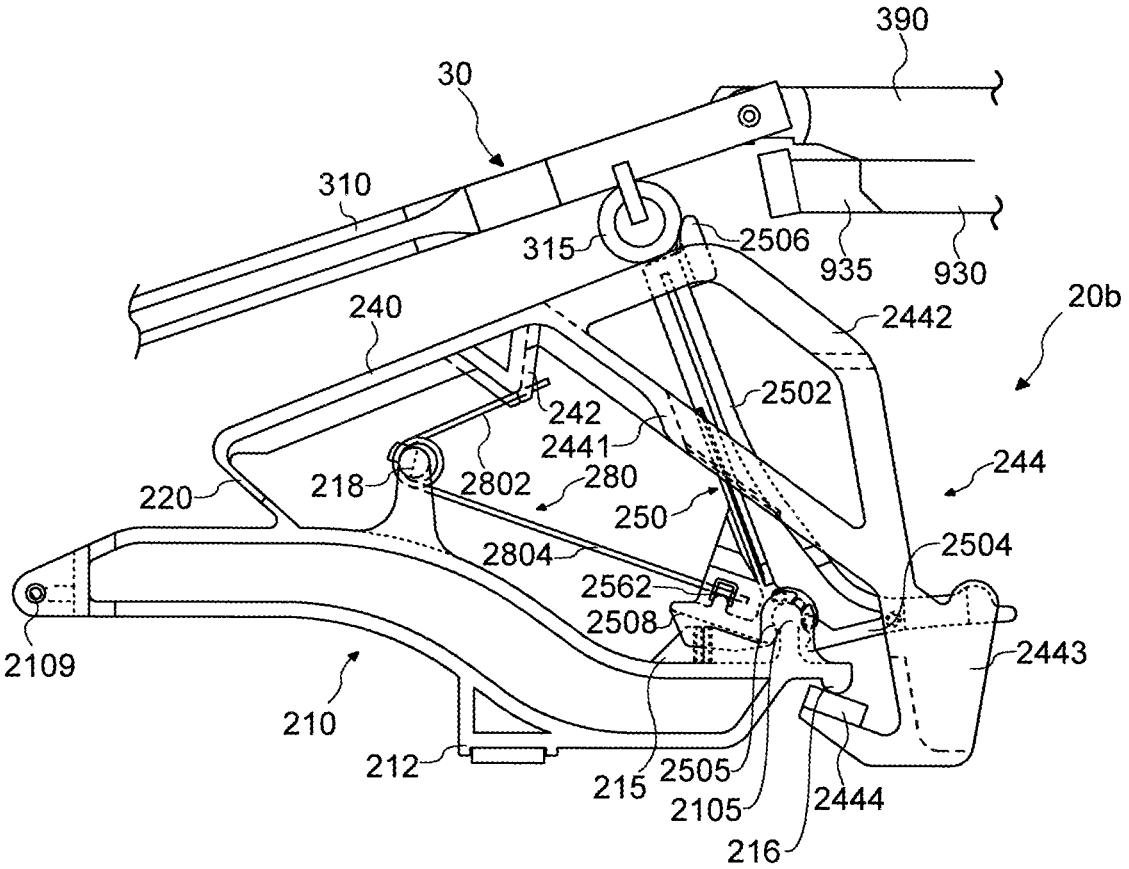
FIG. 7 is a side view showing the configuration of the support assembly and the jack stopper in the keyboard apparatus according to one embodiment of the present invention.

FIG. 7 is a side view showing the configuration a support assembly 20*b* according to one embodiment of the present invention. In the following, only portions different from those of the support assembly 20*a* shown in FIG. 3 are described.

In the support assembly 20*b* shown in FIG. 7, a support connecting portion 2505 is provided to one side of the jack 250, and rotatably fits in the jack support portion 2105 of the support 210. The large jack (first jack) 2502 has the other side provided with a rib 2506. The rib 2506 projects upward (hammer roller 315 side) from a contact surface with which an upper end of the large jack (first jack) 2502 makes contact with the hammer roller 315. While a tip portion of the large jack (first jack) 2502 on the other side overlaps the outer portion 2442 of the extension portion 244, the rib 2506 projects upward from the outer portion 2442. The rib 2506 is provided on the other side of the large jack (first jack) 2502, and rotates with the large jack (first jack) 2502. The rib 2506 and the large jack (first jack) 2502 may be integrally formed, or the rib 2506 may be prepared as a separate component and may be attached to the large jack (first jack) 2502.

Together with the tip portion of the large jack (first jack) 2502, the rib 2506 makes contact with the hammer roller 315, thereby regulating the rotation range of the jack 250. In this sense, the rib 2506 can be regarded as a jack rotation stopper. The rib 2506 is preferably provided to a small jack (second jack) 2504 side at one end portion of the large jack (first jack) 2502. This configuration allows the upper end portion of the large jack (first jack) 2502 and the rib 2506 to make contact with the hammer roller 315. Also, the rib 2506 has a surface opposite to the surface with which the hammer roller 315 makes contact, the opposite surface making contact with the jack stopper 935. With the rib 2506 provided, the rotation range of the large jack (first jack) 2502 is reliably regulated by the jack stopper 935. Furthermore, with the rib 2506 projecting from the outer portion 2442 of the repetition lever 240, the jack stopper 935 can be placed at a suitable position which does not interfere with the operation of the support assembly 20*b*.

The rib 2506 is preferably shaped so that the surface which makes contact with the jack stopper 935 has a curved shape. For example, the surface of the rib 2506 which makes contact with the jack stopper 935 may have a convex curved shape. Also, the surface of the rib 2506 which makes contact with the jack stopper 935 may be provided with a protruding portion. The protruding portion preferably does not have a sharp tip but is formed in a curved shape. The number of protruding portions may be one or more. This shape can decrease a contact area between the rib 2506 and the jack stopper 935. This can reduce friction between the rib 2506 and the jack stopper 935 and can also reduce a contact sound.

The rib 2506 may be integrally formed with the jack 250. For example, when the jack 250 is a resin-made structure manufactured by injection molding or the like, the rib 2506 can be formed at one end of the large jack (first jack) 2502 as having a contiguous shape. According to this configuration, the number of components of the jack 250 can be reduced.

2. Operation of Support Assembly

The operation of the support assembly 20*b* and the hammer assembly 30 according to the present embodiment is described with reference to FIG. 8A and FIG. 8B.

Figure 8A:
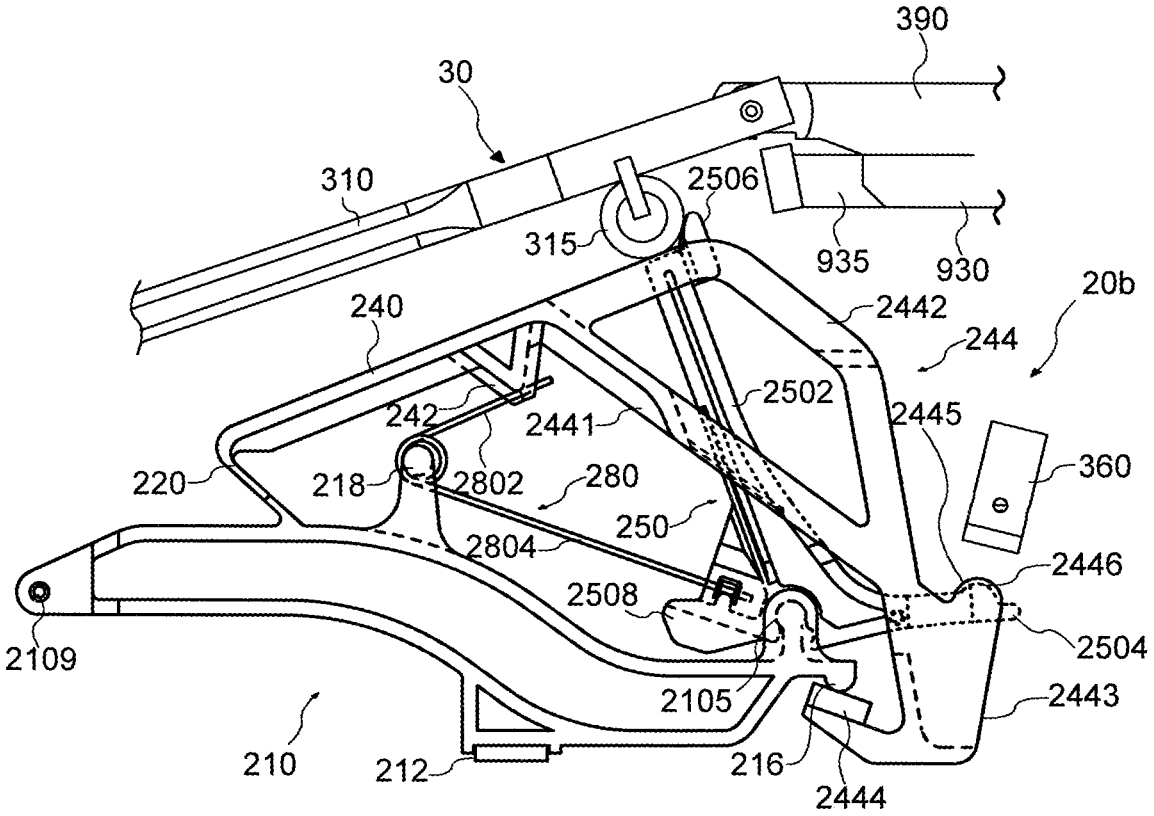
FIG. 8A is a side view for describing a motion of the support assembly in one embodiment of the present invention.
Figure 8B:
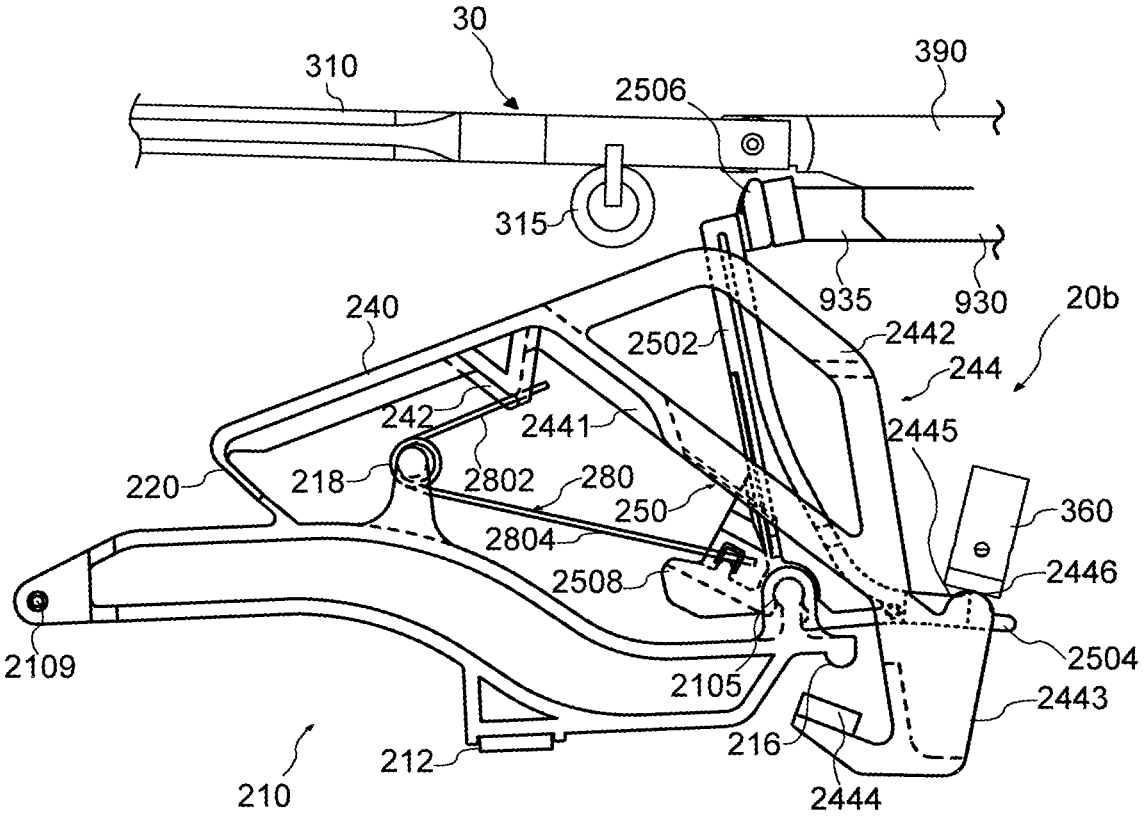
FIG. 8B is a side view for describing a motion of the support assembly in one embodiment of the present invention.

FIG. 8A shows a stationary state before the key is pressed down. In the stationary state, the hammer roller 315 may be supported by the repetition lever 240, and the rib 2506 may project upward from the outer portion 2442 and may be close to or in contact with the hammer roller 315. FIG. 8B shows a state (operation state) when the key is pressed down. The operation at this moment is similar to the operation shown in FIG. 5B. A relation among the rib 2506, the hammer roller 315, and the jack stopper 935 is now described in detail. The rotation path of the rib 2506 provided to the large jack (first jack) 2502 is provided so as to cross in an operation range in which the hammer roller 315 rotates. Furthermore, the jack stopper 935 is provided on the rotation path of the rib 2506. This causes the rib 2506 to make contact with the jack stopper 935 when the large jack (first jack) 2502 rotates as being detached from the hammer roller 315, and the rotation of the large jack (first jack) 2502 is regulated. Thus, the large jack (first jack) 2502 can be prevented from falling more to the front side. On the other hand, with the rib 2506 provided, even when the jack 250 rotates to a rotation center side of the support 210, the position of the tip of the large jack (first jack) 2502 is prevented from falling to a depth side from the hammer roller 315. The projecting portion 2508 may be omitted. However, while the projecting portion 2508 does not make contact with the support 210 when the jack 250 is in a stationary state, the projecting portion 2508 has an operation of regulating the rotation range when the key is pressed down, then the large jack (first jack) 2502 is detached from the hammer roller 315, and then the key is returned to the position before depression with the action of the coil spring 280. In any case, with the rib 2506 provided to the large jack (first jack) 2502, together with the small jack (second jack) 2504, the rotation range of the jack 250 can be regulated. This configuration allows the operation of the above-described double escapement mechanism to be stabilized even when the key is successively pressed down. In key releasing, the rib 2506 is provided to the other side of the large jack (first jack) 2502 at a position capable of making contact with the hammer roller 315, thereby stabilizing the operation of the jack 250. The rib 2506 is preferably provided to a portion opposite to the rotation center of the support 210 on the other side of the large jack (first jack) 2502 so that the upper end portion of the large jack (first jack) 2502 is retained at a position making contact with the hammer roller 315.

In this manner, according to the present embodiment, the rib 2506 is provided, thereby allowing the rotation range of the jack 250 to be limited between the hammer roller 315 and the jack stopper 935. This can stabilize the operation of the jack 250 even when the key is repeatedly pressed down (the key is pounded) and, in turn, can stabilize the operation of the support assembly 20. The rib 2506 described in the present embodiment may be implemented in combination with the support assembly 20*a*_2 where the outer portion 2442 is omitted, shown in FIG. 3.

INDUSTRIAL APPLICABILITY

In the above-described embodiments, an electronic piano is described as an example of the keyboard apparatus to which the support assembly is applied. However, the present invention is not limited to this, and the support assembly disclosed in the above embodiments can be applied also to a grand piano (acoustic piano) and a keyboard apparatus with its action mechanism similar to that thereof.

REFERENCE SIGNS LIST

1 . . . keyboard apparatus, 20 . . . support assembly, 30 . . . hammer assembly, 50 . . . sound emission mechanism, 110 . . . key, 120 . . . capstan screw, 210 . . . support, 2105 . . . jack support portion, 2109 . . . through hole, 212 . . . support heel, 215 . . . guide portion, 216 . . . stopper, 218 . . . spring support portion, 220 . . . flexible portion, 240 . . . repetition lever,

242 . . . spring contact portion, 244 . . . extension portion, 2441 . . . inner portion, 2442 . . . outer portion, 2443 . . . coupling portion, 2444 . . . stopper contact portion, 2445 . . . first contact portion, 2446 . . . second contact portion, 250 . . . jack, 2502 . . . large jack (first jack), 2504 . . . small jack, (second jack) 2505 . . . support connecting portion, 2506 . . . rib, 2508 . . . projecting portion, 2562 . . . spring contact portion, 280 . . . torsion coil spring, 2802 . . . first arm, 2804 . . . second arm, 290 . . . support flange, 310 . . . hammer shank, 315 . . . hammer roller, 320 . . . hammer, 360 . . . regulating portion, 390 . . . shank flange, 410 . . . hammer stopper, 510 . . . sensor, 520 . . . shielding plate, 550 . . . signal converting unit, 560 . . . sound source unit, 570 . . . output unit, 900 . . . bracket, 910 . . . balance rail, 920 . . . support rail, 930 . . . shank rail, 935 . . . jack stopper, 940 . . . hammer stopper rail, 950 . . . sensor rail

What is claimed is:

1. A keyboard apparatus, comprising:

a plurality of keys each rotatable with a predetermined stroke;

a support assembly which includes a support with a first side rotatably arranged with a support rail and a jack with the first side rotatably supported by the support, and rotates with depression of any of the plurality of keys;

a hammer unit which is operated by an action of the jack;

a shank rail which rotatably supports the hammer unit;

a regulating portion which extends from the shank rail and makes contact with the support assembly; and a jack stopper which makes contact with the jack which rotates with the depression of any of the plurality of keys, wherein the jack stopper is placed on a rotation path of the jack and protrudes from the shank rail which does not rotate with the depression of any of the plurality of keys, and wherein the shank rail, the regulating portion, and the jack stopper are arranged on a same side with respect to the jack.

2. The keyboard apparatus according to claim 1, wherein the jack stopper is shared by the plurality of keys.

3. The keyboard apparatus according to claim 1, wherein the jack stopper has a width in contact with the jack respectively arranged to the plurality of keys.

4. The keyboard apparatus according to claim 3, wherein the jack stopper has a width in contact with the jack respectively arranged to the plurality of keys for each octave units.

5. The keyboard apparatus according to claim 1, wherein the jack has, on a second side opposite to the first side, a rib projecting to a side of the hammer unit.

6. The keyboard apparatus according to claim 5, wherein the rib makes contact with the jack stopper when the jack is detached from the hammer unit by the depression of the key to rotate.

7. The keyboard apparatus according to claim 1, wherein the jack stopper has a contact surface which makes contact with the jack.

8. The keyboard apparatus according to claim 7, wherein the contact surface of the jack stopper is placed on the rotation path of the jack.

9. The keyboard apparatus according to claim 7, wherein the contact surface of the jack stopper includes a soft material.

* * * * *